US008028382B2

(12) United States Patent
Alitowski

(10) Patent No.: US 8,028,382 B2
(45) **Date of Patent: *Oct. 4, 2011**

(54) CHILD-SAFE FASTENING DEVICE

(76) Inventor: Adrienne Alitowski, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/772,950

(22) Filed: May 3, 2010

(65) Prior Publication Data

US 2010/0205788 A1 Aug. 19, 2010

Related U.S. Application Data

(63) Continuation of application No. 12/050,801, filed on Mar. 18, 2008, now Pat. No. 7,716,793, which is a continuation of application No. 11/145,098, filed on Jun. 2, 2005, now Pat. No. 7,356,889.

(51) Int. Cl.
*A44B 99/00* (2010.01)
*F16B 2/20* (2006.01)

(52) U.S. Cl. ..... 24/499; 24/507; 24/521

(58) Field of Classification Search ..... 24/489, 24/499–511, 513, 517–521; 446/330, 376, 446/378, 379; 269/6
See application file for complete search history.

(56) References Cited

U.S. PATENT DOCUMENTS 1,250,264 A * 12/1917 Zierold ..... 24/508
2,308,915 A * 1/1943 Haimes et al. ..... 63/15.4
3,078,367 A * 2/1963 Jackson ..... 362/296.01
3,928,933 A * 12/1975 Iwamoto ..... 446/330
4,182,318 A * 1/1980 Beige et al. ..... 602/20
4,590,727 A * 5/1986 Ghahremani et al. ..... 52/406.3
4,685,464 A * 8/1987 Goldberger et al. ..... 600/344
4,725,257 A * 2/1988 Barishman et al. ..... 446/370
D302,939 S * 8/1989 Ruskin ..... D8/402
4,858,285 A * 8/1989 Dala et al. ..... 24/555
4,877,163 A * 10/1989 Zimmerman ..... 223/93
5,081,730 A * 1/1992 Moody ..... 5/608
5,245,715 A * 9/1993 Dinkins ..... 5/417
5,327,922 A * 7/1994 Deroche ..... 135/118
5,400,478 A * 3/1995 Levinsohn et al. ..... 24/72.5
5,429,541 A * 7/1995 Landon ..... 446/70
5,437,493 A * 8/1995 Weisleder ..... 297/150
5,832,672 A * 11/1998 Griffiths et al. ..... 52/4
5,857,601 A * 1/1999 Greenwood ..... 224/409
6,263,703 B1 * 7/2001 Kenney ..... 63/14.1
6,305,586 B1 * 10/2001 Wong ..... 223/96
6,330,898 B1 * 12/2001 Chang ..... 160/24
6,383,053 B1 * 5/2002 Segers ..... 446/386
6,386,490 B1 * 5/2002 Suh ..... 248/104
6,393,675 B1 * 5/2002 Gaetke ..... 24/563
6,434,797 B1 * 8/2002 Sagman ..... 24/3.13
6,439,521 B1 * 8/2002 Wilson et al. ..... 248/227.3
6,564,703 B1 * 5/2003 Lin ..... 100/234
6,640,985 B1 * 11/2003 Cheng ..... 211/118
6,644,636 B1 * 11/2003 Ryan ..... 269/6
6,684,422 B2 * 2/2004 LeFevre et al. ..... 5/496
6,699,100 B1 * 3/2004 Burns ..... 446/369
D494,450 S * 8/2004 Schultz et al. ..... D8/356
6,772,486 B2 * 8/2004 Ellwood ..... 24/334

(Continued)

*Primary Examiner* — Robert Sandy
(74) *Attorney, Agent, or Firm* — Fountain Law Group, Inc.; George L. Fountain; Vy H. Vu

(57) ABSTRACT

A child safe fastening device including a clip, one or more than one padded layer covering one or more surfaces of the clip and one or more than one cover layer secured to the padded layer. The clip, the padded layer, and the cover layer form a plush device.

21 Claims, 5 Drawing Sheets

U.S. PATENT DOCUMENTS 6,813,814 B1 * 11/2004 Schultz ..... 24/560
6,829,431 B1 * 12/2004 Haven et al. ..... 392/441
6,832,781 B2 * 12/2004 Rastegar et al. ..... 280/806
6,834,400 B2 * 12/2004 Zanardelli et al. ..... 4/572.1
6,837,413 B1 * 1/2005 Raymond et al. ..... 227/67
7,356,889 B2 * 4/2008 Alitowski ..... 24/521
7,716,793 B2 * 5/2010 Alitowski ..... 24/564
2002/0170569 A1 * 11/2002 Silva ..... 132/277
2004/0054291 A1 * 3/2004 Schulz et al. ..... 600/500

* cited by examiner

CHILD-SAFE FASTENING DEVICE

CROSS-REFERENCE TO RELATED APPLICATIONS

The present application is a continuation of patent application Ser. No. 12/050,801, entitled "Child-Safe Fastening Device", filed on Mar. 18, 2008 which in turn is a continuation of patent application Ser. No. 11/145,098 now U.S. Pat. No. 7,356,889, issued on Apr. 15, 2008, all of which are incorporated herein by reference.

BACKGROUND

Various types of devices have been developed to assist individuals in transporting infants and small children. More specifically, strollers are the most common devices used to transport children. Strollers vary in complexity and include many different features. For instance, a basic stroller is a wheeled device that includes an area to hold a child or infant and handles for an individual to push or pull the stroller. More complex strollers may include features such as, but not limited to, storage areas, trays, and sunshades. These features are generally developed to protect and/or improve the comfort of the infant/child. In particular, different types and shapes of sunshades have been developed to shield and protect an infant or child from the environmental elements such as, but not limited to, the sun, wind, rain, or loud sounds.

While these sunshades have been useful, individuals need to drape a blanket over the sunshade to provide additional protection or privacy for the infant/child. Typically, the blanket is suspended from the stroller sunshade. Because the blanket is merely suspended from the sunshade, the blanket has a tendency to shift as the stroller is moved or the infant/child may dislodge it by grabbing it. As a result, the blanket may fall off the stroller and become soiled, wet, or caught in the stroller's wheels. Some individuals attempt to use their hand to hold the blanket onto the stroller. However, this may be uncomfortable and may make it difficult to maneuver and control the stroller. Alternatively, individuals may attempt to stuff the blanket ends into crevices of the stroller, but the blanket invariably works free due to the movement of the stroller or when a child or infant pulls on the blanket. Other attempted solutions include the use of large metallic clamps to keep the blanket on the stroller. However, these clips are dangerous to the child as the child may get fingers trapped in the clips or may be otherwise injured when coming into contact with these clips.

Accordingly, what is needed is a child-safe device that allows an individual to easily secure a blanket to a stroller.

SUMMARY

Briefly, and in general terms, various embodiments are directed to child-safe fastening devices. In one embodiment, the child-safe device comprises a clip, one or more than one padded layer covering one or more surfaces of the clip, and one or more than one cover layer secured to the padded layer. The clip, the padded layer, and the cover layer form a plush device.

In another embodiment, the child-safe fastening device comprises a clip and one or more than one padded layer covering one or more surfaces of the clip. The clip comprises a first member, a second member, and a low-tension biasing element pivotally coupling the first and second members together.

In yet another embodiment, the child-safe fastening device comprises a clip, one or more padded layers for covering the surfaces of the clip, and a cover layer secured over the one or more padded layers. Additionally, the clip comprises a hinge assembly coupling a first member to a second member. In this embodiment, the first member and the second member have a recess sized to grasp items. Also, the hinge assembly comprises a rod and a low-tension biasing element.

Other features and advantages of the embodiments disclosed herein will become apparent from the following detailed description when taken in conjunction with the accompanying drawings, which illustrate by way of example, the features of the embodiments.

DETAILED DESCRIPTION

Various embodiments disclosed herein are directed to child-safe fastening devices. The fastening device may be used to secure an item such as, but not limited to, a blanket, bib, baby cloth, bags, shopping list, papers, or other items to a surface of a stroller, crib, chair, swing, or the like. In one embodiment, the fastening device is sized to removably connect to a part of a stroller. For instance, the fastening device may couple a blanket to the stroller's canvas top, sunshade, food tray, one or more stroller legs, bars, arm rests, or the like. The child-safe fastening device is safe for use around a child. Additionally, the child-safe device is not a potential hazard if a child handles the fastening device. For instance, the device is padded to create a plush, child-friendly object. The device also includes a low-tension biasing member intended to prevent injury should a child's hand or finger become caught within the fastening device.

Figure 1:
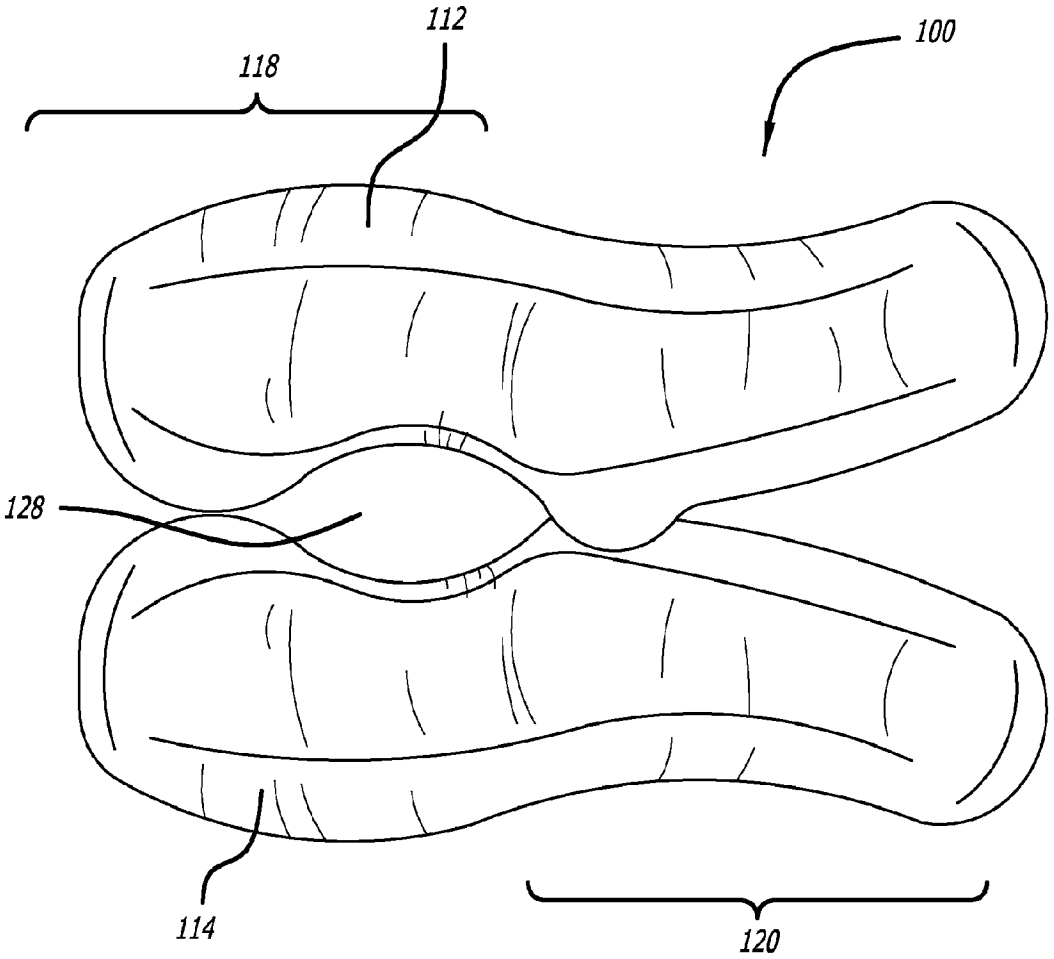
FIG. 1 is a side plan view of one embodiment of a child-safe fastening device.

Referring now to the drawings, wherein like reference numerals denote like or corresponding parts throughout the drawings and, more particularly to FIGS. 1-7, there are shown various embodiments of a child-safe fastening device 100. Specifically, FIG. 1 illustrates one embodiment of a child-safe fastening device 100. The device 100 is provided with sufficient padding to be safe for use around a baby or child. That is, the device 100 is generally a plush object that does not include any sharp edges or have any harmful hard surfaces.

In the embodiment shown in FIG. 1, the device 100 comprises a first member 112 pivotally coupled to a second member 114. The first member 112 and the second member 114 each have a gripping region 118 at the first end of the device 100. The gripping regions 118 of each member 112 and 114 are in contact with one another when the device 100 is in a closed position. The first member 112 and second member 114 also define an opening 128 adjacent to the gripping region 118. The opening 128 is sized to grasp or fit around the diameter of objects. Examples of such objects include but are not limited to, a leg of a baby stroller, a rod-shaped portion of a stroller, or surfaces of a chair, swing, or crib. The first member 112 and the second member 114 include a handle region 120, located at the end opposite the gripping region 118. The handle regions 120 of each member 112 and 114 are generally spaced apart when the device 100 is in a closed position.

Figure 2:
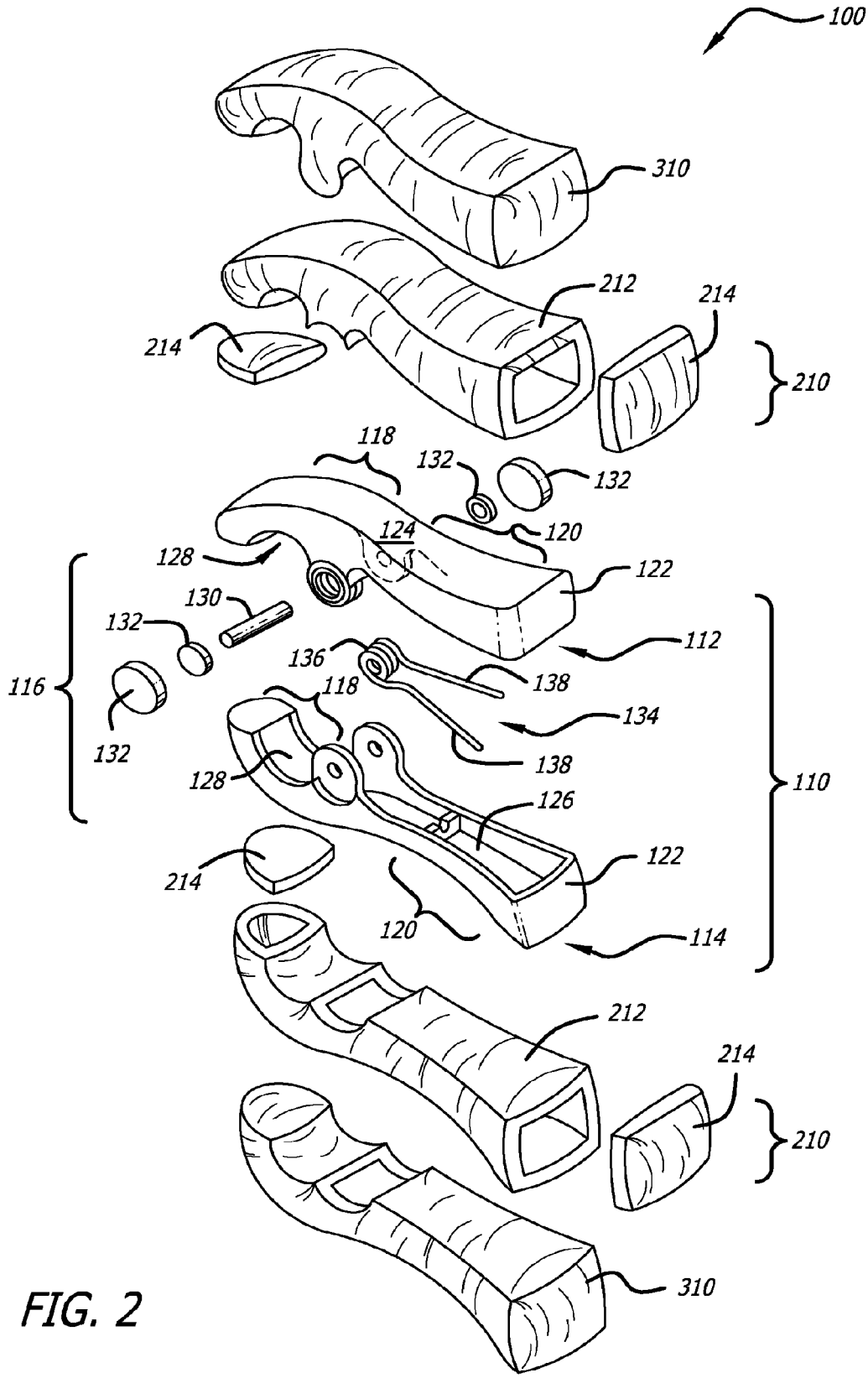
FIG. 2 is an exploded perspective view of the embodiment of FIG. 1.

Referring now to FIG. 2, one embodiment of the device 100 includes a clip 110, a padded layer 210, and a cover layer 310. In an alternate embodiment, the device (not shown) is composed of a clip 110 and one or more padded layers 210. In yet another embodiment, the device (not shown) is composed of a clip 210 and one or more cover layers 310, where the cover layers are thick enough provide sufficient padding to prevent potential injury from the hard surfaces of the clip 110. In yet another embodiment, one or more padding layers 210 are integrated with the cover layer 310 to form a single layer (not shown).

As shown in FIG. 2, the clip 110 comprises a first member 112 pivotally coupled to a second member 114 by a hinge assembly 116. The first member 112 and the second member 114 of the clip 110 are generally S-shaped. In an alternate embodiment, the first and second members 112 and 114 are generally flat members (not shown). In other embodiments, the first and second members 112 and 114 may have any shape. The first and second members 112 and 114 also include one or more side walls 122 as shown in FIG. 2. In an alternate embodiment, the first and second members (not shown) do not have side walls.

Generally, each of the first and second members 112 and 114 have a grasping region 118, handle region 120, upper surface 124 and lower surface 126. The grasping region 118 of each member 112 and 114 includes a recess 128 that is sized so the device 100 may grasp large objects of relatively large diameter, e.g., a tubular part of a stroller (hand rest, stroller canopy, etc.). In another embodiment, only one member 112 has a recess 128. As shown in FIG. 2, the recess 128 is semi-circular in shape. In other embodiments, the recess 128 may be rectangular, triangular, polygonal, or any other shape known or developed in the art.

In one embodiment, the first member 112 and second member 114 are made of plastic. As those skilled in the art will appreciate, the members 112 and 114 may be made from material such as metal, wood, or any other material known or developed in the art. Regardless of the material used to form the members 112 and 114, the members are desirably lightweight and impact-resistant.

As shown in FIG. 2, each of the members 112 and 114 are secured together by a hinge assembly 116. The hinge assembly 116 comprises a rod 130, and one or more end caps 132, and a biasing member 134. In one embodiment, the hinge assembly (not shown) comprises a biasing member 134 that couples the first member 112 to the second member 114. That is, this embodiment of the hinge assembly (not shown) does not include a rod 130 or end caps 132. The biasing member 134 may be low-tensioned to allow for easy separation of the coupled members 112 and 114. Additionally, a low-tensioned biasing member 134 minimizes the likelihood of injury should an infant's or child's fingers or hands become trapped between the members 112 and 114.

In the embodiment shown in FIG. 2, the biasing member 134 comprises one or more coils 136 and opposing arms 138 extending from the coils. As those skilled in the art will appreciate, the number of coils 136 and the length and/or angle of the opposing arms 138 may be varied to adjust the tension (i.e., spring constant) of the biasing member 134. In another embodiment, the biasing member 134 is a spring (not shown) that is coupled to and spans between the members 112 and 114. The spring may be a compression spring, nested compression spring, conical spring, variable-pitch spring, torsion spring, or the like. In yet another embodiment, the biasing member 134 may be a folded metal spring. In other embodiments, the biasing member 134 may be any biasing member known or developed in the art.

Referring again to FIG. 2, the fastening device 100 also includes a padded layer 210. The padded layer 210 provides cushioning and is intended to prevent the likelihood of injury if an infant or child comes into contact with the device 100. As shown in FIG. 2, the padded layer 210 comprises a padded body 212 and end caps 214 to encase the surfaces of the members 112 and 114. End caps 214 are placed at the end of the handle region 120 of the first and second members 112 and 114. End caps 214 are also placed on the opposing surfaces of the grasping region 118 of the first and second members 112 and 114.

In another embodiment of the child-safe fastening device 100, the padded body 212 and the end caps 214 of the padded layer 210 are formed as a unitary structure. In yet another embodiment, the fastening device 100 includes more than one padded layer 210.

According to one embodiment, the padded layer 210 is composed of foam or high-density foam. In another embodiment, the padded layer 210 is composed of cotton padding or other cushioning materials known or developed in the art. In one embodiment, the padded layer 210 is about one-half of an inch thick. As those skilled in the art will appreciate, the thickness of the padded layer 210 may be varied so long as the device 100 is plush to the touch. Alternatively, in another embodiment, the padded layer 210 is thick enough to prevent harmful edges from being felt.

As shown in FIG. 2, the device 100 also includes a cover layer 310 that envelopes the padded layer 210 and leaves no visible signs of the padded layer and/or the clip 110. In one embodiment, the cover layer 310 is composed of multiple pieces of material that mimic the shape of the padded layer 210. Alternatively, the cover layer 310 may be a unitary structure.

In one embodiment, the cover layer 310 may be sewn over the padded layer 210. In an alternate embodiment, adhesives may be used to secure the cover layer 310 to the padded layer 210. In yet another embodiment, the cover layer 310 may be friction-fitted over the padded layer 210. That is, the cover layer 310 slides over the padded layer 210 or any other layer and is then held in place via friction between the layers. In another embodiment, the cover layer 310 may be reversibly fitted over the device 100. That is, the cover layer 310 is coupled to the device 100 so that the cover layer may be removed for cleaning or replaced with a different cover layer. In this embodiment, the cover layer 310 may be friction-fitted onto the device 100 and secured in place with any appropriate or suitable attachment means (not shown), such as, adhesive, VELCRO®, snaps, buttons or thread.

According to various embodiments, the cover layer 310 is made from a fabric material such as cotton, cotton blends, nylon, rayon, silk, spandex, or combinations thereof. In another embodiment, the cover layer 310 is made of a water-resistant fabric or is treated with a water-resistant coating. Optionally, the cover layer 310 is made from a stain-resistant fabric. As those skilled in the art will appreciate, any material may be used to form the cover layer 310 that is preferably non-toxic and otherwise safe if an infant or child should come into contact with it.

Figure 3:
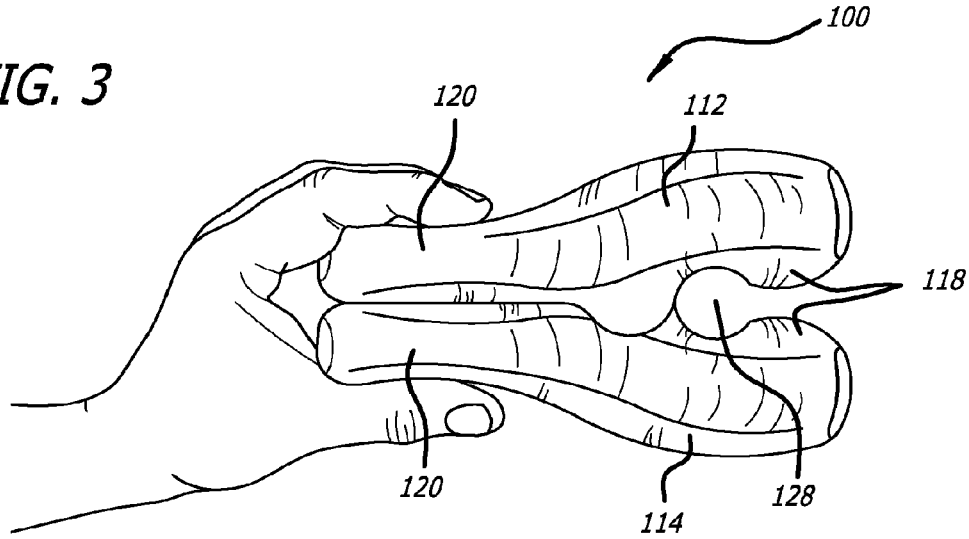
FIG. 3 is a side plan view of the embodiment of FIG. 1 in an open configuration.

Referring to FIG. 3, when opposing forces are applied to the handle portions 120 of the members 112 and 114, the gripping regions 118 of the members are separated. The space 128 between the gripping regions 118 may vary in size and is sufficiently sized to secure an item to a support surface or the like. Accordingly, the gripping regions 118 may be used to secure a blanket or other item to a support surface such as, but not limited to, a canopy, tray, stroller leg, or a rod-shaped portion of a stroller.

Figure 4:
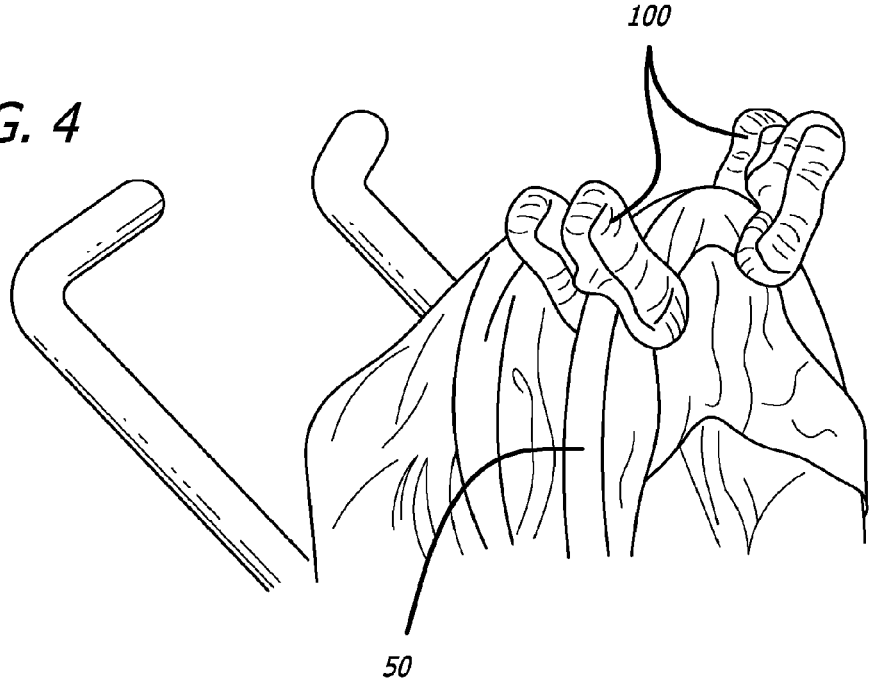
FIG. 4 is a perspective view of two child-safe fastening devices coupled to a stroller.
Figure 5:
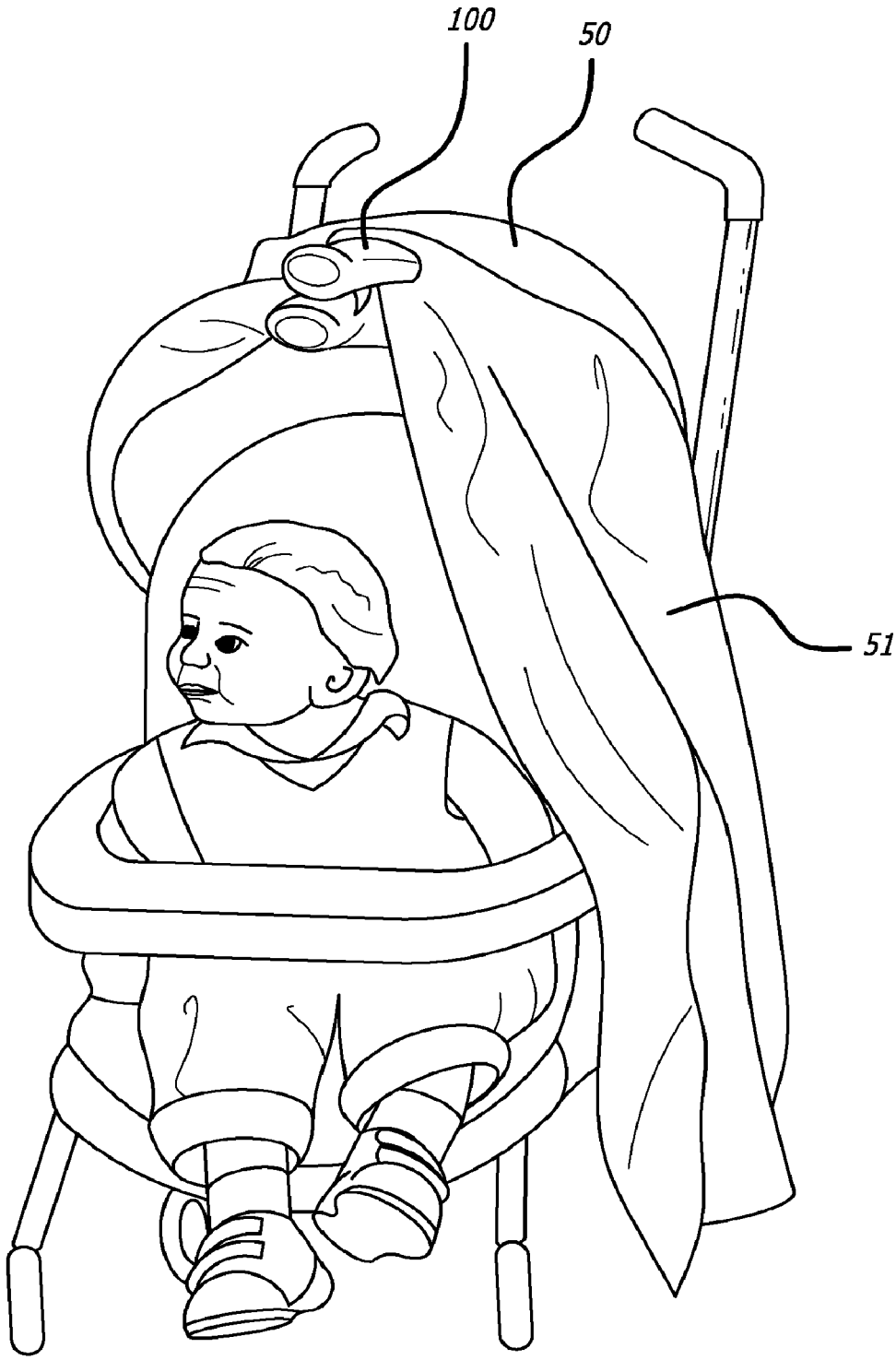
FIG. 5 is a perspective view of one embodiment of a child-safe fastening device used to secure a blanket to a stroller.
Figure 6:
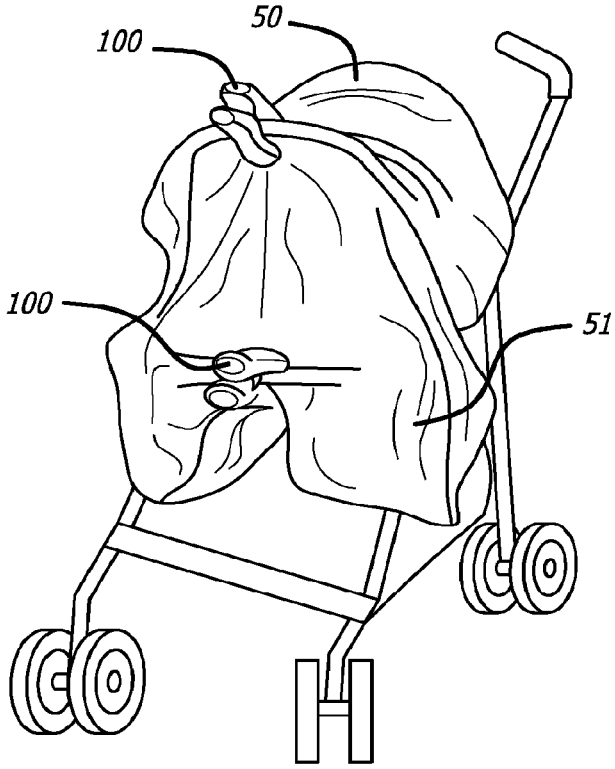
FIG. 6 is a perspective view of two child-safe fastening devices used to secure a blanket over an opening of a stroller.

FIGS. 4-6 illustrate examples of child-safe fastening devices securing a blanket to a stroller. In particular, FIG. 4 shows two child-safe fastening devices 100 coupled to a stroller canopy 50. FIG. 5 illustrates a child-safe fastening device used to secure a blanket 51 to the stroller canopy 50. FIG. 6 shows two child-safe fastening devices 100 used to secure the blanket 51 over the opening of the stroller. When a blanket 51 is positioned over the opening of the stroller as shown in FIG. 6, the infant or child is better protected from any environmental elements such as sunlight, wind, loud noises, or a combination thereof. Furthermore, the child or infant may be kept warm when the blanket 51 is positioned over the opening of the stroller. By using the devices 100 to secure the blanket to the stroller, an individual is better able to operate/control the stroller with both hands because the individual does not need to use a free hand to hold the blanket 51 on the stroller.

Alternatively, one or more child-safe devices 100 may be used to secure a blanket over the lap of an infant or child (not shown). As a result, the secured blanket is less likely to fall off a moving stroller or be removed by the child. In another use, individuals may use the device 100 to secure a blanket (or any other item) to their garments to prevent the blanket from slipping or falling off the individual. For instance, a mother may use the device 100 to ensure that a blanket does not move when nursing an infant. As those skilled in the art will appreciate, one or more devices 100 may be used to secure a bag, purse, baby cloth, shopping list, papers or other items to a surface of the stroller, crib, chair, swing, or the like.

Figure 7:
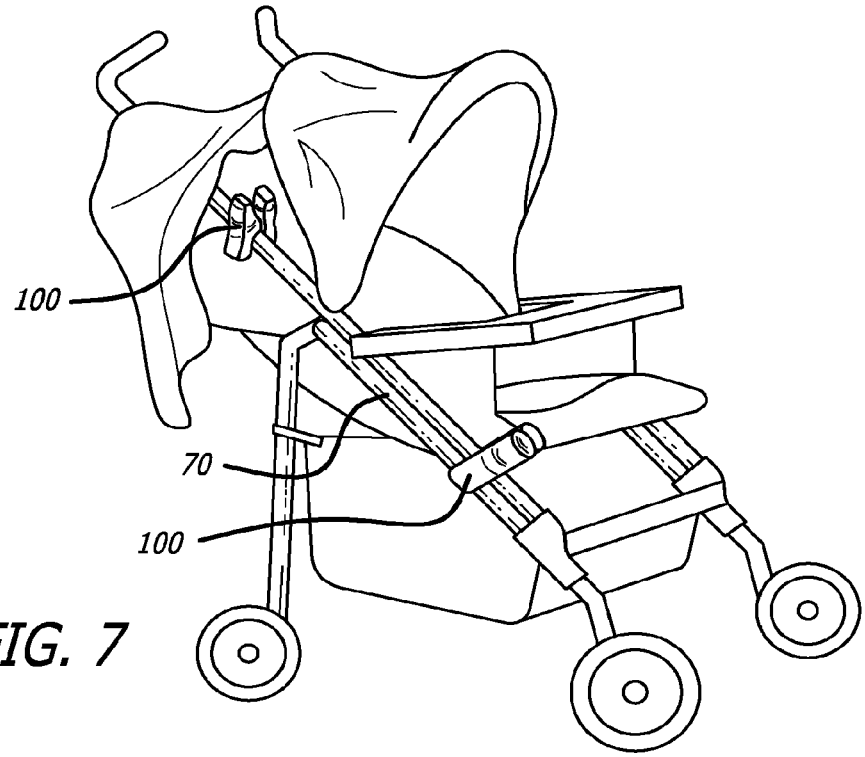
FIG. 7 is a perspective view of two child-safe fastening device couple to a stroller leg.

FIG. 7 illustrates two child-safety fastening devices 100 coupled to a leg 70 of the stroller. As those skilled in the art will appreciate, the devices 100 may be secured to any portion or surface of the stroller when not in use. That is, the openings 128 on the first and second members 112 and 114 are sized so that the device 100 may grasp large objects of relatively large diameter, e.g., a tubular part of a stroller (hand rest, stroller canopy, etc.).

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A child-safe fastening device for securing an article onto a child-supporting device, comprising:

a clip comprising:

a first member including a first gripping region and a first handle region;

a second member including a second gripping region and a second handle region; and a biasing element to bias the first gripping region of the first member against the second gripping region of the second member with a tension so as to prevent injury to a child, but sufficient to secure the article onto the child-supporting device;

one or more padded layer covering the clip; and a cover layer covering the one or more padded layer.

2. The child-safe fastening device of claim 1, wherein the one or more padded layer comprises foam, high-density foam, or cotton padding.

3. The child-safe fastening device of claim 1, wherein a thickness of the one or more padded layer is about one-half of an inch.

4. The child-safe fastening device of claim 1, wherein a thickness of the one or more padded layer is configured to form a plush feel when touched.

5. The child-safe fastening device of claim 1, wherein the cover layer comprises a water-resistant material, stain-resistant material, cotton, cotton blends, nylon, rayon, silk, spandex, or combination thereof.

6. The child-safe fastening device of claim 1, wherein the child-supporting device comprises a stroller, crib, chair, or swing.

7. The child-safe fastening device of claim 1, wherein the article comprises a blanket, a bib, a baby cloth, a bag, a shopping list, or a paper.

8. The child-safe fastening device of claim 1, wherein the first and second gripping regions are configured to define an opening configured to grasp or fit around an object.

9. The child-safe fastening device of claim 8, wherein the object comprises a tubular part of a stroller, a surface of a chair, a surface of a swing, or a surface of a crib.

10. The child-safe fastening device of claim 8, wherein only one of the first or second member includes a recess to define the opening.

11. The child-safe fastening device of claim 1, wherein the first and second members are each generally S-shaped.

12. A child-safe fastening device for securing an article onto a child-supporting device, comprising:

a clip comprising:

a first member including a first gripping region and a first handle region;

a second member including a second gripping region and a second handle region, wherein the first and second members are pivotally coupled together at a region between the respective first and second gripping regions and the respective first and second handle regions; and a biasing element to bias the first gripping region of the first member against the second gripping region of the second member with a tension sufficient to secure the article onto the child-support device, yet insufficient to injure a child in a case the child's finger or hand becomes situated between the first and second gripping regions of the clip;

one or more padded layer covering the clip; and a cover layer covering the one or more padded layer.

13. The child-safe fastening device of claim 12, wherein the first and second members respectively include first and second concave recesses, and wherein the first and second concave recesses define a cavity when the first and second members are biased in a closed position.

14. The child-safe fastening device of claim 12, further comprising an attachment means for securing the cover layer to the one or more padded layer.

15. The child-safe fastening device of claim 12, wherein the cover layer is reversibly fitted over the one or more padded layer.

16. The child-safe fastening device of claim 12, wherein at least one of the first and second members has a concave recess.

17. The child-safe fastening device of claim 16, wherein the concave recess is in the shape of a semi-circle, rectangle, diamond, or triangle.

18. A child-safe fastening device for securing an article onto a child-supporting device, comprising:

a clip comprising:

a first member including a first gripping region and a first handle region;

a second member including a second gripping region and a second handle region, wherein the first and second members are pivotally coupled together at a region between the respective first and second gripping regions and the respective first and second handle regions; and a biasing element adapted to bias the first gripping region of the first member against the second gripping region of the second member with a tension sufficient to secure the article onto the child-supporting device, yet insufficient to injure a child in a case the child's finger or hand becomes situated between the first and second gripping regions of the clip;

one or more padded layer covering the clip; and a cover layer covering the one or more padded layer.

19. The child-safe fastening device of claim 18, wherein the cover layer comprises a water-resistant material.

20. The child-safe fastening device of claim 18, wherein the cover layer comprises a stain-resistant material.

21. The child-safe fastening device of claim 18, wherein the cover layer comprises a non-toxic material.

* * * * *